United States Patent [19]

Kornatowski

[11] 4,216,733

[45] Aug. 12, 1980

[54] AUTOMATIC BOBBIN WINDING SYSTEM

[75] Inventor: Boleslaw Kornatowski, Elizabeth, N.J.

[73] Assignee: The Singer Company, Stamford, Conn.

[21] Appl. No.: 2,044

[22] Filed: Jan. 8, 1979

[51] Int. Cl.[2] ..... D05B 57/08; D05B 59/00

[52] U.S. Cl. ..... 112/184; 112/221; 112/273; 112/279

[58] Field of Search ..... 112/181, 182, 184, 273, 112/279, 186, 221 (U.S. only)

[56] References Cited

U.S. PATENT DOCUMENTS

| | | | |
|---|---|---|---|
| 2,760,024 | 8/1956 | Tunstall | 112/273 X |
| 3,143,093 | 8/1964 | Parry | 112/221 X |
| 3,303,802 | 2/1967 | Crawford | 112/184 |
| 3,331,343 | 7/1967 | Goebel et al. | 112/181 X |
| 3,332,381 | 7/1967 | Dobner et al. | 112/184 X |
| 3,386,400 | 6/1968 | Ivanko | 112/181 |
| 3,601,073 | 8/1971 | Simpson | 112/273 X |
| 3,693,566 | 9/1972 | Ketterer | 112/184 |
| 3,732,834 | 5/1973 | Mayer | 112/273 |
| 3,815,529 | 6/1974 | Adams et al. | 112/221 X |
| 3,832,960 | 9/1974 | Mayer et al. | 112/279 |
| 3,872,809 | 3/1975 | Adams et al. | 112/221 |
| 3,928,752 | 12/1975 | Darwin | 112/273 X |
| 4,040,367 | 8/1977 | Crawford et al. | 112/273 |

*Primary Examiner*—Wm. Carter Reynolds

*Attorney, Agent, or Firm*—Edward P. Schmidt; Robert E. Smith; Edward L. Bell

[57] ABSTRACT

An automatic bobbin winding system for lockstitch sewing machine having the capability to wind needle thread around said bobbin while said bobbin is supported within the looptaker of the sewing machine wherein a depleted condition of the bobbin is sensed causing the work feed system to be disconnected, the bobbin winding system to be enabled and endwise reciprocation of the needle bar to be suspensed after needle thread is introduced into the bobbin winding system in order to fully wind the bobbin supported within the looptaker. When the bobbin is completely wound, a full bobbin sensing device is activated which terminates the bobbin winding, reinitiates the work feeding system and the endwise reciprocation of the sewing needle in order to continue stitching at that point where bobbin thread depletion was first sensed.

4 Claims, 9 Drawing Figures

AUTOMATIC BOBBIN WINDING SYSTEM

BACKGROUND OF THE INVENTION

This invention relates to lockstitch sewing machines having mechanism for replenishing bobbin thread while the bobbin remains in place in the loop taker, and more particularly, to a system for automatically initiating bobbin winding at the end of the thread supply in the bobbin, and automatically terminating bobbin winding to revert to a sewing mode when the bobbin has been filled.

It is known in the prior art to provide bobbin thread replenishing mechanisms which are operative on an instruction from an operator to replace thread in the bobbin of a lockstitch looptaker. Such a device is shown in the U.S. Pat. No. 3,693,566, issued on Sept. 26, 1972 to Ketterer.

It is also known in the prior art to provide for a sewing machine having two bobbins situated in a bobbin case supported in a looptaker, and a sensing means to determine a low condition of a bobbin for the purpose of initiating the filling of the other bobbin utilizing a special bobbin winding motor. In this prior art device, a great deal of complication and extra parts are necessary in order to provide two bobbins, sensing means and winding means including a separate winding motor. Such a device is shown in the U.S. Pat. No. 3,332,381, issued on July 25, 1967 to Dobner et al.

There also exists in the prior art devices for detecting the depletion of thread, such as is disclosed in U.S. Pat. No. 3,129,680, of Doerner. Many or all of the thread depletion detectors in the prior art detect a condition of low bobbin thread as opposed to a condition of no bobbin thread remaining on the spool. Thus, these depletion detectors are effective to warn an operator that the bobbin thread is about to be used up. However, an automatic winding system would require that the bobbin be completely empty prior to attempting to refill the bobbin in order to avoid damaging the work material by rewinding the bobbin while a length of thread thereon remains connected to the work material.

What is required is a device to sense the complete exhaustion of the bobbin thread, to inhibit further stitching by the sewing machine, to initiate rewinding of the bobbin, and to re-initiate stitching by the sewing machine upon completion of the winding of the bobbin.

SUMMARY OF THE INVENTION

An automatic bobbin winding system which would meet the above requirements utilizes a bobbin which enlarges when the last thread is removed therefrom, which enlargement is used to close an empty bobbin switch indicating bobbin thread exhaustion. The empty bobbin switch activates a relay coil, which relay coil actuates relay contacts placing voltage on a first solenoid. The first solenoid is carried by a frame which encircles a worm supported on a feed drive shaft. The solenoid actuates a lever carried by the frame and having an end which engages with the worm, the rotation of which thus causes the solenoid, lever and frame to move to a position where arms extending from the frame uncouples a fed drive shaft gear from the feed drive shaft, rotates a bobbin winding actuating lever to a wind position, and actuates a switch activating a second solenoid releasing the sewing machine needle bar from its drive means. The sewing machine needle reciprocation and fabric feed is thus inhibited while the bobbin is refilled with thread. A bobbin case supporting the bobbin in the looptaker is fashioned with a sensing means for determining when the bobbin has been fully wound. Actuation of the sensing means will release the first solenoid thereby allowing the feed drive shaft gear to recouple with the feed drive shaft, deactivate the second solenoid and, release the bobbin winding actuating lever to its normal release position. Thus at the completion of bobbin winding, stitching will automatically be re-initiated.

BRIEF DESCRIPTION OF THE DRAWINGS

The invention will be described in detail below with reference to the accompanying drawings of a preferred embodiment in which:

Referring now to FIG. 1, there is shown an elevation of a sewing machine 20 having a portion of the bed 22 thereof partially cut away in order to show the bobbin winding and work feeding systems therein. A standard 25 extends upwardly from the bed 22 and supports a bracket arm 27 overhanging the work supporting surface 23 of bed 22. The bracket arm 27 terminates in a head 29 within which is supported for endwise reciprocation a needle bar 31 which terminates in a sewing needle 32, and a presser bar 34 which terminates in a presser foot 35. The needle bar 31 is supported in a gate (not shown) as disclosed in the U.S. Pat. No. 3,815,529, issued on June 11, 1974 to Adams et al, which is hereby incorporated by reference herein. In that patent is disclosed the means for supporting the needle bar 31 for endwise reciprocation and for lateral oscillation and, additionally, a basting stitch mechanism by which the needle bar may be disconnected from its drive means in order to effect a basting stitch by holding in suspension the endwise reciprocation of the needle bar for a number of cycles between each stitch. The teaching of the above referenced patent may be modified as taught in the U.S. Pat. No. 3,872,809, issued on Mar. 22, 1975 to Adams et al which is hereby incorporated by reference herein. In this latter referenced patent it is disclosed how a solenoid device may be coupled to the device disclosed in the earlier referenced patent in order to uncouple the needle bar from its driving mechanism by means of an electrical signal, for a purpose to be discussed below. Thus, a latch mechanism 33 is carried by the needle bar 31 and provides a connection to driving crank 37, which connection is separable by activation of solenoid 194, as will be explained below.

Figure 1:
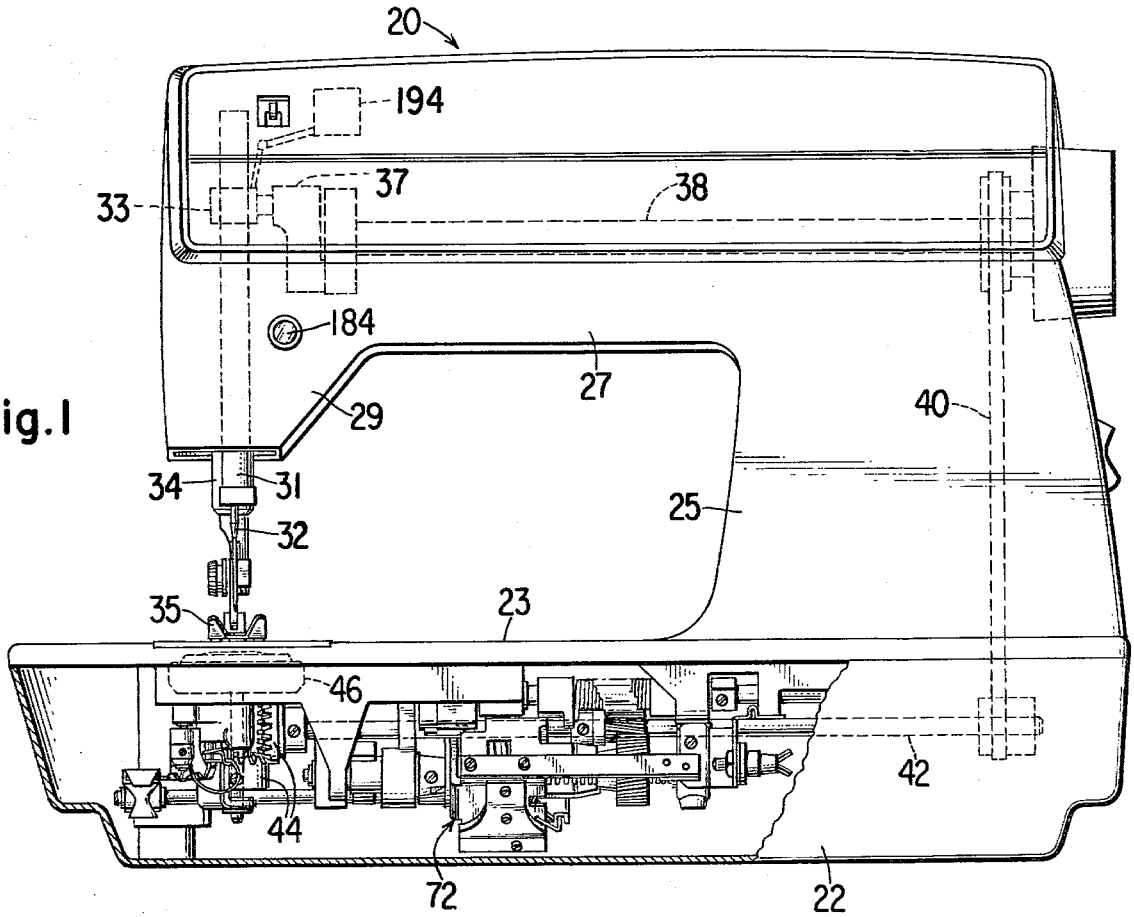
FIG. 1 is an elevation of the sewing machine in which the invention has been incorporated.

The needle bar 31 is urged in endwise reciprocation in the usual fashion in sewing machines by a horizontal arm shaft 38 which is driven by the main drive means (not shown) of the sewing machine supported elsewhere within the frame. The opposite end of arm shaft 38 is connected via a belt 40 to a hook drive shaft 42 supported in the bed 22 of the sewing machine 20. The hook drive shaft 42 is connected by miter gears 44 to the rotating hook 46 which may be similar to that disclosed in the U.S. Pat. No. 3,693,566, issued on Sept. 26, 1972 to Ketterer, and assigned the assignee of the instant invention, which is hereby incorporated by reference herein. The patent of Ketterer discloses a bobbin thread replenishing mechanism for lockstitch looptaker which mechanism is mechanically actuated by an operator when the thread on the bobbin has been completely depleted. By slight modifications to the mechanism disclosed in the patent of Ketterer, that mechanism may be used in the automatic bobbin winding system of this invention.

Figure 2:
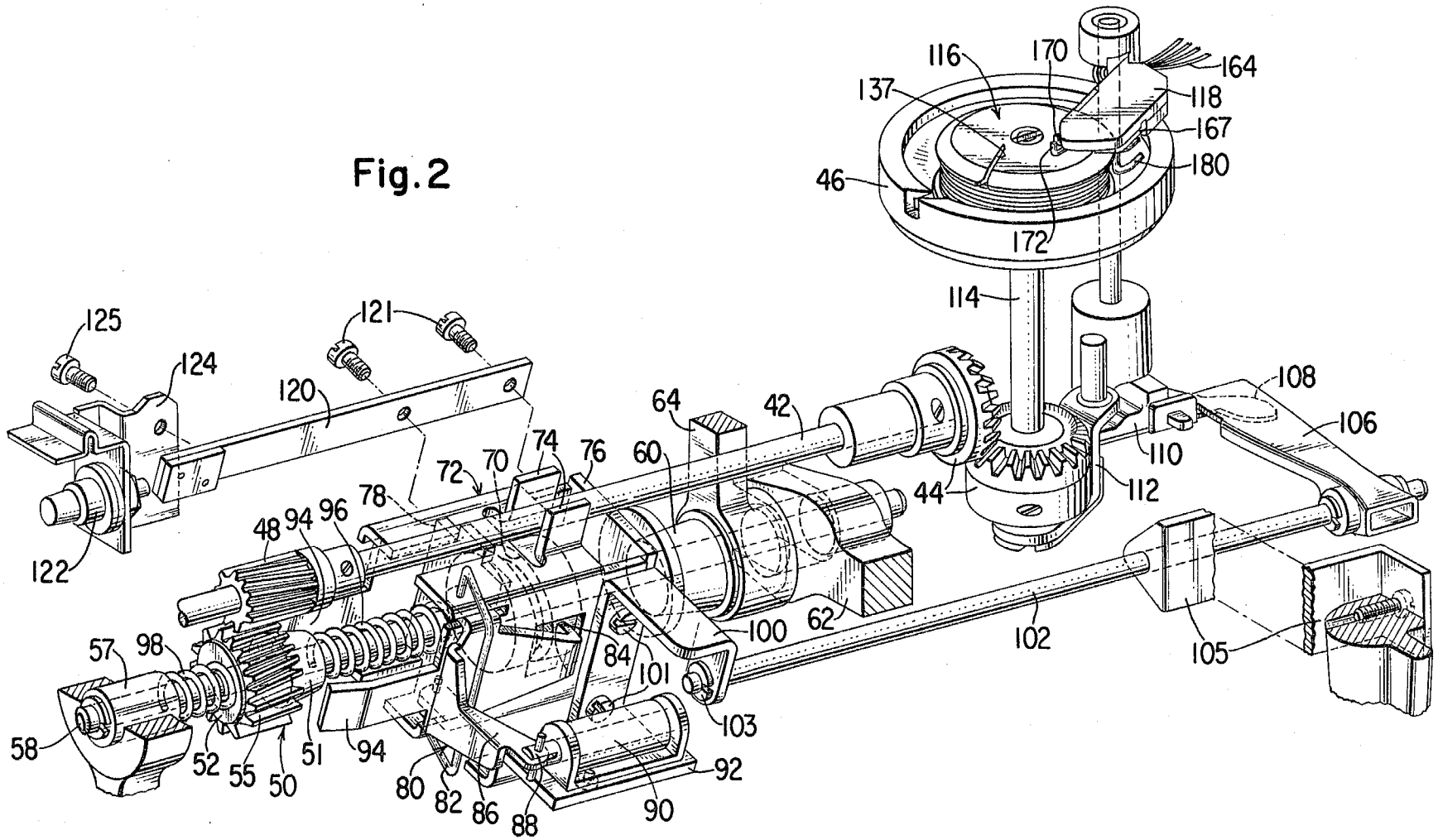
FIG. 2 is a perspective view of the feed and bobbin winding system partially visible in FIG. 1, as viewed from the rear thereof.

Referring now to FIG. 2 there is shown a rear perspective view of the components mounted in the bed 22 of the sewing machine 20. Thus, there is included the hook drive shaft 42, the miter gears 44 and the rotating hook 46. The hook drive shaft 42 also support thereon a helical gear 48. The helical gear 48 meshes with clutch gear 50 carried by feed drive shaft 58. The feed drive shaft 58 also supports a feed cam and eccentric 60 which revolves once for each stitch cycle to provide feed lift via the feed fork 62 and feed advance via the pitman 64, substantially as disclosed in U.S. Pat. No. 3,527,183, issued on Sept. 8, 1977 to Szostak et al which is hereby incorporated by by reference herein. Thus, feed motion for a work material is obtained via the feed cam and eccentric 60 connected by way of gears 48, 50 to the main drive of the sewing machine. In order to obtain automatic bobbin winding, which may occur in the middle of a seam, it will be necessary to provide some means for disconnecting the feed cam and eccentric 60 from the main drive of the sewing machine when bobbin winding takes place, in order to avoid damaging the work material, thread or sewing needle. To this end, a worm 70 is affixed to the feed drive shaft 58. The worm 70 is surrounded by a sheet metal frame 72, the sheet metal frame having anti-rotation ears 74 straddling the hook drive shaft 42, a plate 76 affixed thereto and carried on the collar of the worm, and, a second plate 78 affixed thereto and carried on the shaft 58. Thus, the sheet metal frame 72 is supported for sliding motion in a direction parallel to the axis of the feed drive shaft 58. The sheet metal frame 72 additionally supports thereon a bell crank 80 which pivots on pin 82 extending through the sheet metal frame and bell crank on both sides thereof. One end of the bell crank 80 is formed with a finger 84 arranged, when the bell crank is pivoted, to extend within the teeth of the worm 70. The second arm 86 of the bell crank 80 is connected by a clevis 88 to a solenoid 90 affixed to a bracket 92 also carried by the sheet metal frame 72. The sheet metal frame 72 is additionally formed with a pair of arms 94 on either side of the feed drive shaft 58 and adjacent the collar 51 of the clutch gear 50. The collar 51 is affixed in the usual fashion to the feed drive shaft 58, and a compression spring 96 extends between the collar and the second plate 78 of the sheet metal frame 72, urging the frame in a direction away from clutch gear 50.

Figure 3:
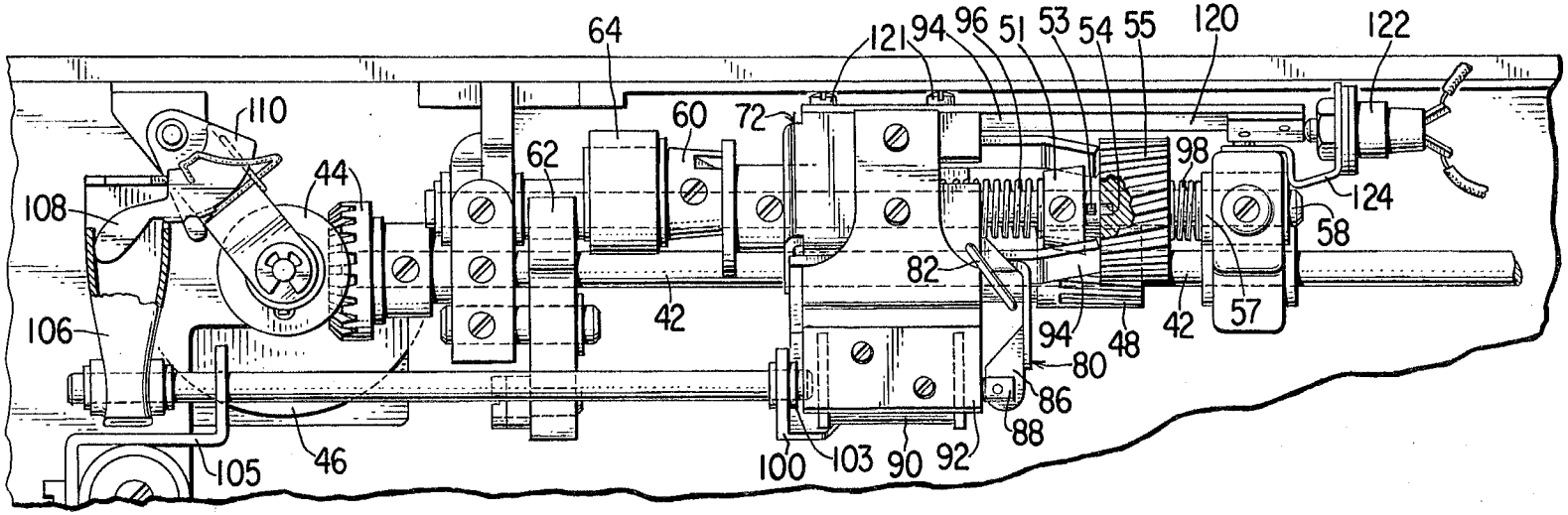
FIG. 3 is a bottom view of the feed and bobbin winding system in the winding position showing details of the invention.

In operation when the solenoid 90 is activated the finger 84 of the bell crank 80 will extend into the teeth of the worm 70 and the rotation of the feed drive shaft 58 will move the bell crank and the sheet metal frame 72 to which it is attached toward the clutch gear 50 in opposition to the compression spring 96. Continued motion of the sheet metal frame 72 towards the clutch gear 50 will cause the arms 94 of the frame to impinge upon the clutch gear. The clutch gear 50 is constructed on a bushing 52 which is slidable on the feed drive shaft 58. The collar 51 of the clutch gear 50 is fashioned with a pin 53 which normally extends into a cavity 54 in the gear 55 (see FIG. 3). Thus, the gear 55 is slidable on the feed drive shaft 58 away from the collar 51 under the urging of the arm 94 of the sheet metal frame 72. A second compression spring 98 extends between a bushing 57 for the feed drive shaft 58 and the bushing 52 of the gear 55 so as to urge the gear into engagement with the pin 53 of the collar 51 when the arms 94 of the sheet metal frame 72 are removed from contact with the gear. The gear 55 will reengage with the collar 51 when the cavity 54 and pin 53 are realigned, thereby preserving the timing of feed lifting and feed advance to needle bar reciprocation. While the gear 55 is disengaged from the collar 51 there will be no feed motion.

Also attached to the sheet metal bracket 72 by screws 101 is an L frame 100. A rod 102 is connected to the L frame 100 by a spring ring 103 and is supported by and slidable in a sheet metal member 105 affixed to the sewing machine frame. The opposite end of the rod 102 is attached to a lug 106 the other end of which is connected to a pusher 108 affixed to a radial arm 110 of the bobbin winder, which bobbin winder is more fully disclosed in the above reference patent of Ketterer. A greater understanding of the bobbin thread replenishing mechanism will be had by reference to the patent of Ketterer; however, briefly it may be stated that rotation of the radial arm 110 elevates the angle bracket 112 and driving spindle 113 (see FIGS. 4 and 7) situated internally of the looptaker shaft 114. The driving spindle on the interior of the looptaker shaft 114 causes the bobbin 116 supported in the looptaker 46 to revolve and wind thread thereabout. Thus, when the solenoid 90 is activated by an electrical signal, the sheet metal frame 72 is caused to move by the worm 70 and disconnect the gear 55 from the collar 51 thereof to halt feeding of the work material by the sewing machine. Simultanteously, the sheet metal frame 72 by way of rod 102 causes the arm 118 to extend over the bobbin 116 which action would deflect thread from the hook 46 to the bobbin for winding thereof, and will raise the driving spindle 113 within the looptaker shaft 114 to a bobbin driving position to cause upper needle thread to be wound on the bobbin.

Also shown in FIG. 2, a link 120 has one end thereof affixed to the sheet metal frame 72 by screws 121. The other end of the link 120 is aligned with the actuator button of switch 122. The switch 122 is carried by bracket 124 which may be affixed to the sewing machine frame by screw 125. The switch 122 and the link 120 are arranged such that when the solenoid 90 is activated the link 120 will move with the sheet metal frame 72 and actuate the switch at the end of travel of the frame. Thus upon activation of the solenoid 90 it has been disclosed that the feed cam 60 has been disconnected by shifting of the clutch gear 50, the bobbin winding mechanism has been implemented and the switch 122 has been actuated. The purpose for actuation of the switch will be more clearly specified below.

Figure 4A:
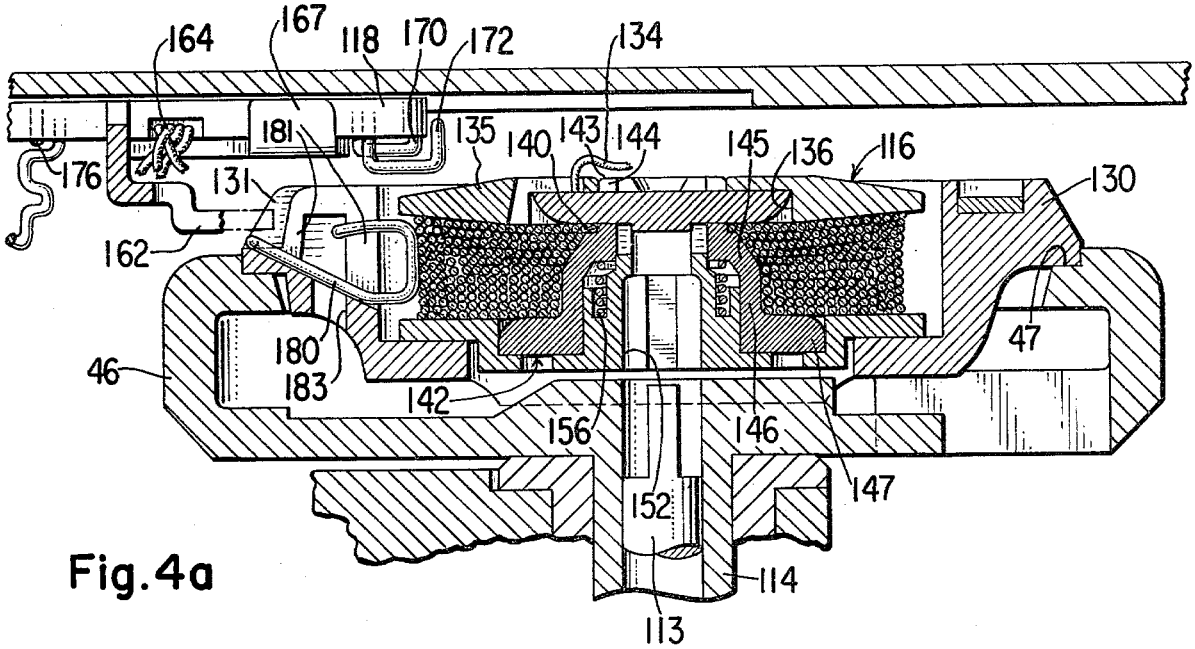
FIGS. 4, a and b, are cross sectional views of the rotating hook bobbin case and bobbin of the sewing machine shown in FIG. 1 in, respectively, the full bobbin condition and the empty bobbin condition.
Figure 4B:
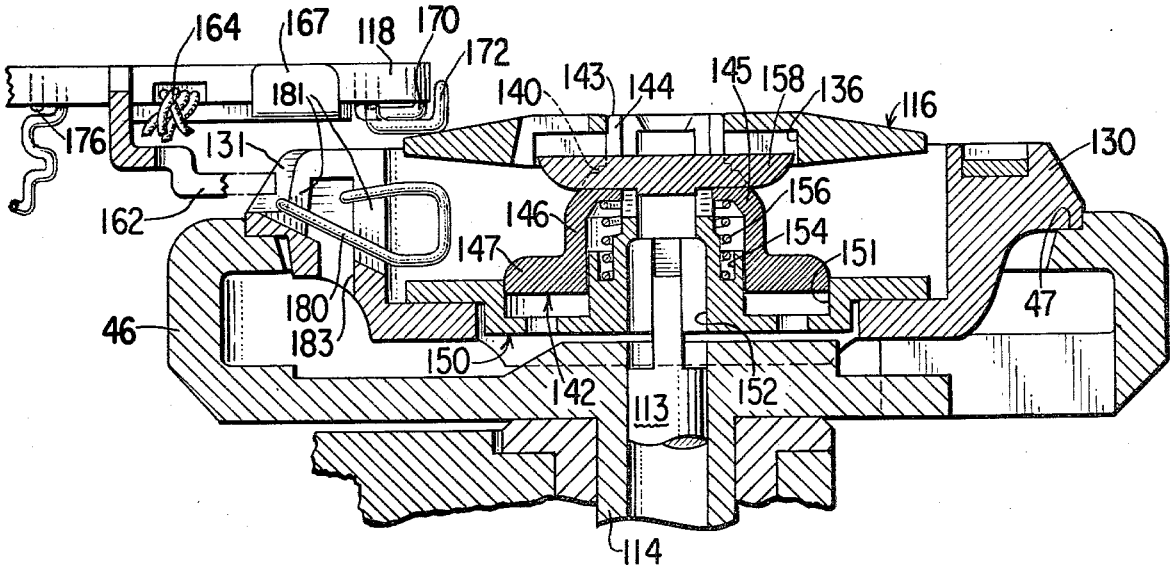

Referring now to FIG. 4 there are shown two views of the bobbin 116 used in the automatic bobbin winding system. In FIG. 4(*a*) the bobbin 116 is shown in a full condition whereas in FIG. 4(*b*) the bobbin is depleted. In FIG. 4(*a*) the looptaker 46 is shown supporting therein a bobbin case 130 on the raceway 47 of the looptaker. The bobbin 116 is supported in a cavity in the bobbin case 130 and is fashioned with an upper flange 135 affixed to an upper post 142. The upper post 142 comprises a hollow tubular upper portion 143 having a diametral slot 144 therethrough. The hollow tube 143 of the upper post 142 abruptly enlarges as at 140, to a hollow frustrum 145, thence to a larger hollow tube 146 which terminates in an annular platform 147. The upper flange 135 is further fashioned with a groove 136 on the inside of the flange, which groove is aligned with the diametral slot 144 in the upper post 142. The lower flange 150 of the bobbin 116 is fashioned with an annular recess 151 to receive the annular platform 147 of the upper post 142. The lower flange 150 is further formed with an inner tube 152 concentric to the lower flange and a slip fit with the larger hollow tube 146 and the hollow tube 143. The inner tube 152 forms an upstanding post on the lower flange 150, the upstanding post having a hollow interior to receive the driving spindle 113. The inner tube 152 is fashioned with a second annular recess 154 to receive a compression spring 156 which extends between the larger hollow tube 146 of the outer post 142 and the second annular recess of the inner tube. A bar 158 is affixed to a slot extending transversely across the upper end of the inner tube 152 and extends through the diametral slots 144 in the outer post 142 into the groove 136 in the upper flange 135. Thus, the compression spring 156 operates to urge the upper flange 135 and the lower flange 150 to separate from each other within the limits of motion permitted by the diametral slot 144 in the outer post 142 being urged against the bar 158 captured by the inner post 152.

Referring to FIG. 4(*a*) it will be noted that when the bobbin 116 is filled, the thread extends into the abrupt discontinuity 140 between the hollow tube 143 and the hollow frustrum 145. The initial turn of thread about the bobbin 116, i.e. one thickness of thread, is forced into this abrupt discontinuity 140 during winding and the compression spring 156 undergoes compression due to the forces exerted on the hollow frustrum 145 of the outer post 142. Thus, the abrupt discontinuity 140 is spaced from the bar 158 the approximate distance of one thickness of thread when the bar is seated in the groove 136 of the upper flange 135. When thread is depleted from the bobbin 116 the last turn of thread is removed from the abrupt discontinuity 140, releasing the restraint on the compression spring 156 and allowing the bobbin 116 to expand as shown in FIG. 4(*b*).

Figure 5:
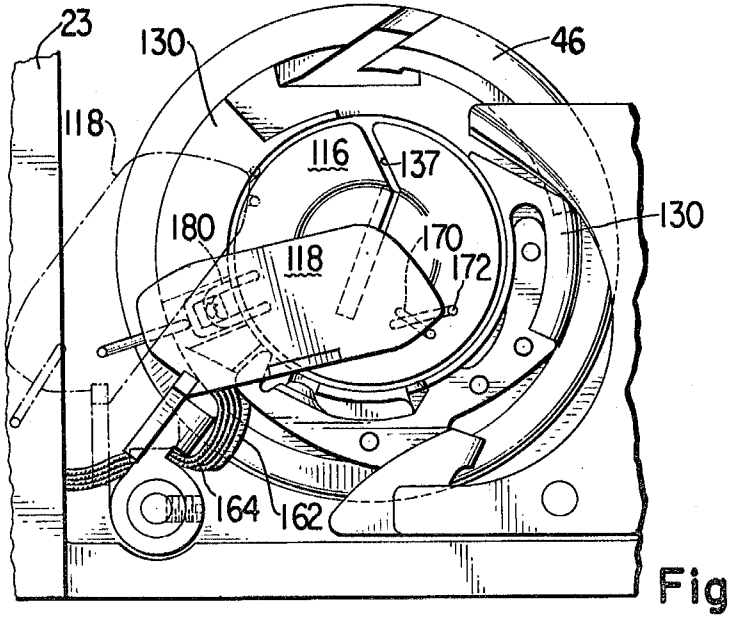
FIG. 5 is a plan of the hook, bobbin case and bobbin with the bobbin winding actuating lever shown in full in the wind position and in phantom in the running position.

Referring now to FIG. 5 there is shown in plan the looptaker 46, bobbin case 130 and bobbin 116 therein together with arm 118 extending over the bobbin. The arm 118 is shown in phantom as it would be positioned when the sewing machine is in operating, or sewing condition. The arm 118 is shown in full as it would be positioned during the bobbin thread replenishing operation. As will be appreciated by reference to the above noted patent of Ketterer, the projection 162 carried by the arm 118 is in a position to deflect the first loop of thread carried around the bobbin case by the looptaker into a position which will direct the thread onto the bobbin 116 for winding thereon. Clearly visible in FIG. 5 is the bundle of wires 164 extending beneath the arm 118.

Figure 6:
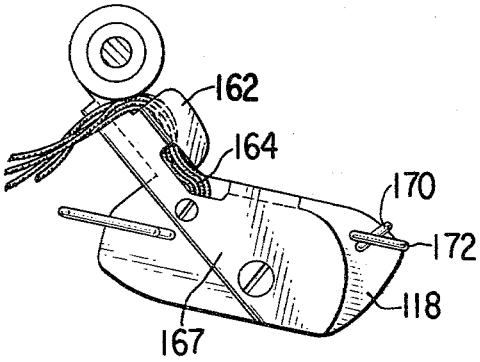
FIG. 6 is a bottom view of the bobbin winding actuating lever to show the position of the contacts thereon.

Referring to FIG. 6, which is a view of the arm 118 from the underside thereof, it will be noted that the arm is a composite of a top plate of phenolic or other insulating material to which a sheet metal support plate 167 has been attached. The bundle of wires 164 is brought between the support plate 167 and the phenolic arm 118, two of the wires being brought forwardly to the exposed wires 170, 172 overhanging the end of the arm. The exposed wires 170, 172 are retained in the phenolic arm 118 by suitable materials such as epoxy, and the connecting leads from the bundle of wires 164 may be brought over through channels cut in the phenolic and subsequently covered with insulating material. In essence the exposed wires 170 and 172 constitutes a switch which may be actuated by pressing the wires together (see also FIG. 4(*b*)).

Figure 7:
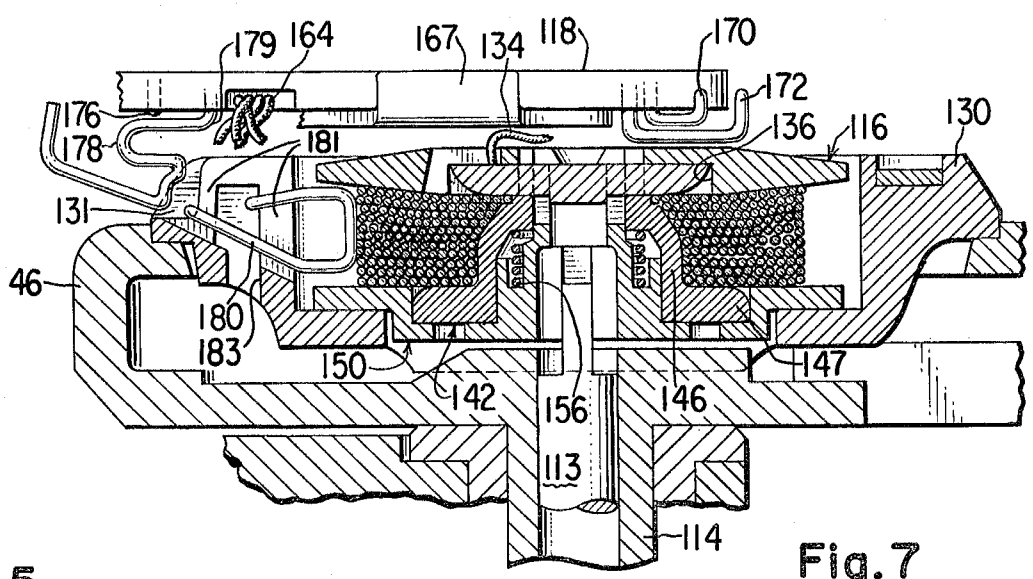
FIG. 7 is a cross section similar to FIG. 4 to show the position of the contacts on the bobbin winding actuating lever with respect to the sensing means on the bobbin case; and, FIG. 8 is a circuit diagram illustrating the electrical connections of the various switch means and solenoids of this invention.

A second pair of wires from the bundle of wires 164 may extend to the other extremity of the arm 118 to be connected to a second pair of exposed wires 176, 178 (see FIG. 7). In FIG. 7, the arm 118 is positioned as shown in full in FIG. 5, in the bobbin wind position. It will be seen from the inspection of FIG. 5 and FIG. 7 that the formed end of the exposed wire 178 is positioned by the arm 118 in the wind position adjacent the bobbin case 130. A spring wire 180 extends between the interior and the exterior of the bobbin case 130 through an adjacent pair of radial slots 181 thereof, with a portion of the spring wire extending externally of the bobbin case in a groove 131, and with both ends of the spring wire terminating in a cavity 183 in the bobbin case (see FIG. 7). The spring wire 180 is normally situated between the flanges 135, 150 of the bobbin 116 (see FIG. 4(*b*)). When the bobbin 116 is full, or nearly full, as is shown in FIG. 4(*a*), the spring wire 180 is pushed outwardly by the thread in the bobbin and will extend as shown through a groove 131 in the wall of the bobbin case 130. In FIG. 7 where the arm 118 is in the wind position, and the bobbin 116 is being filled with thread, it is clear that rotation of the arm has brought the formed wire 178 to the periphery of the bobbin case 130 in a position where the first loop of thread may be cast between it and the bobbin case. In this partially filled position it is apparent that the spring wire 180 will be forced by the thread filling the bobbin 116 to a position where the formed wire 178 will be deflected as at 179 to contact the exposed wire 176. Thus, a full bobbin 116 would be indicated by a closed connection between the wire 176 and formed wire 178.

Figure 8:
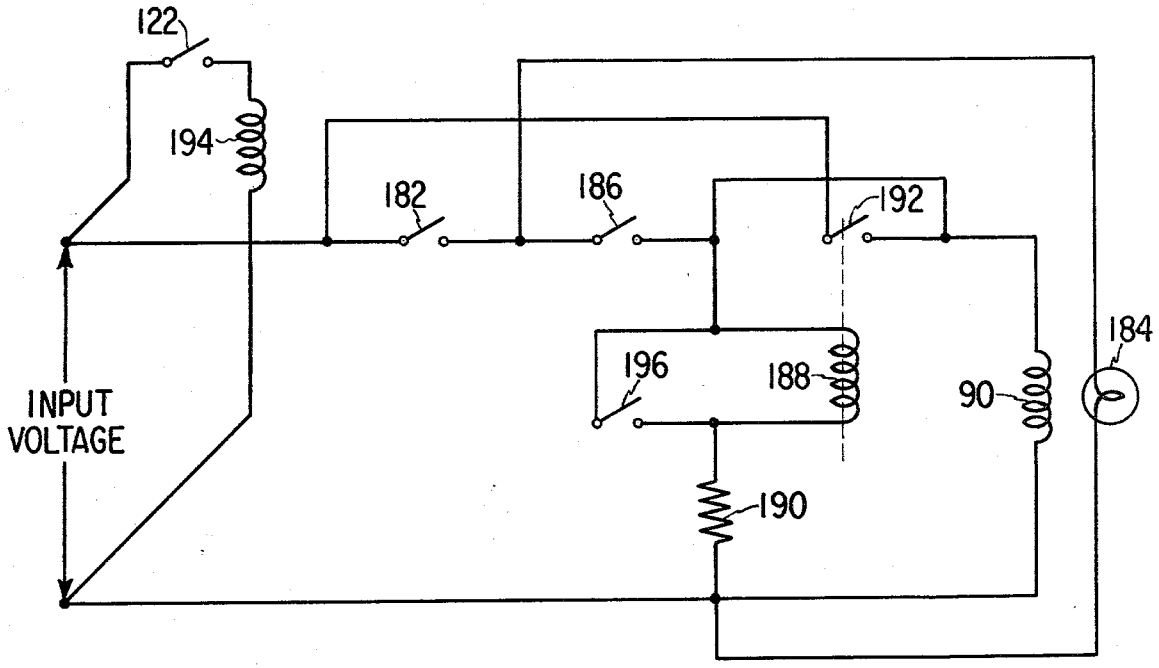

Referring to the wiring diagram of FIG. 8 operation of the automatic bobbin winding system may now be explained. The empty bobbin switch 182 in the wiring diagram is implemented by the wires 170, 172. By reference to FIG. 4(*a*) it will be noted that wires 170, 172 are not connected during sewing machine operation when there is thread on the bobbin 116. However, it will be noted in FIG. 4(*b*) that when the bobbin 116 is empty, the flange 135 thereof is elevated, striking the exposed wires 170, 172 and connecting them together. The exposed wires 170, 172 constitute the switch 182 in the wiring diagram of FIG. 8. Closing of the switch 182 applies the input voltage to lamp 184, thereby providing a visual indication to an operator of an empty bobbin condition (see also FIG. 1). An automatic winding switch 186 may be provided which in the closed position will initiate automatic winding of the bobbin 116. In the open position the switch 186 defeats the automatic winding provision, an operator merely being provided with the visual indication of the lamp 184. Where the switch 186 is in the closed position voltage is applied to a relay coil 188, possibly through a dropping resistor 190. Activation of the relay coil 188 closes the relay contact 192 thereby applying power to solenoid 90, also visible in FIG. 2. As explained above activation of the solenoid 90 causes the sheet metal frame 72 to travel in a direction away from the looptaker 46 and, by way of "L" frame 100, rod 102, and lug 106 moves the arm 118 into the wind position. Motion of the arm 118 into the wind position causes the driving spindle 113 (see FIGS. 4 and 7) to begin driving the bobbin 116. Concurrently or shortly thereafter the clutch gear 50 on the feed drive shaft 58 is disconnected from driving relationship with the feed drive shaft 58 by the arms 94 of the sheet metal frame 72. Again concurrently or shortly thereafter the link 120 which is connected to the sheet metal frame 72 is moved to a position where it actuates switch 122 causing power to be applied to a solenoid 194 of a needle bar release device as disclosed in the above referenced U.S. Pat. No. 3,872,809. Thus the solenoid 194 is effective as disclosed in the above referenced patent to pivot a latch release member into engagement with a coupling member, in order to unlatch the coupling member from a needle bar drive member. In this fashion endwise reciprocation of the needle bar 31 and sewing needle 32 attached thereto is held in abeyance after the initial conveyance of thread by the sewing needle into the bobbin 116 for replenishment thereof as taught in the above referenced U.S. Pat. No. 3,693,566. A thread end 134 (see FIG. 4(*a*)) is caught in a slot 137 (see FIG. 5) of bobbin 116 and extends along the side of the bar 158 and a loop of thread sits between the hollow frustrum 145 and the bar. As the driving spindle 113 drives the bobbin 116 the thread is forced between the bar 158 and the frustrum 145 into the thread gap above the abrupt enlargement 140, retaining the bobbin 116 in the collapsed state against the urgings of the compression spring 156. As explained above, while the bobbin 116 is being rewound, the solenoid 90 will remain activated in order to retain the sheet metal frame 72 in a position to maintain the disconnection of the clutch gear 50 with the feed drive shaft 58, to maintain the arm 118 in the bobbin winding position, and to maintain the link 120 in engagement with the switch 122 in order to suspense endwise reciprocation of the needle bar 31.

In FIG. 7 the bobbin 116 is shown partially wound with thread. Continued winding with additional thread will force the spring wire 180 to the left as viewed in FIG. 7; and when the bobbin 116 is completely filled, the spring wire will engage with the formed wire 178, causing deflection thereof until the exposed wire 176 is contacted by the formed wire. The exposed wire 176 and formed wire 178 constitute the switch 196 of the circuit diagram of FIG. 8. When the bobbin 116 is completely wound, and the switch 196 is closed, a bypass circuit is formed around the relay coil 188 which deactivates the relay coil and permits the relay contacts 192 to drop out. Opening of the relay contacts 192 removes power from solenoid 90, which permits the sheet metal frame 72 to return to its normal position under the urgings of the compression spring 96, which permits the clutch gear 50 to reengage with the collar 51 thereof, opens the switch contacts 122 which deactivates solenoid 194 allowing the needle bar 31 once again to undergo endwise reciprocation, and releases the radial arm 110 of the bobbin winding arrangement to return the arm 118 to a sewing machine operating condition once again. The sewing machine 20 thereupon reverts to a stitching condition and stitching proceeds where interrupted before the last thread was withdrawn from the bobbin 116. In rewinding the bobbin 116 in this manner, the upper thread in the work material is continuous with only the lower side of the work material showing the discontinuity of depleted bobbin thread.

Having thus set forth the nature of the invention, what is sought to be claimed is:

1. A lockstitch sewing machine comprising an endwise reciprocating needle bar;

a sewing needle affixed to the end of said needle bar;

a work feeding system for urging a work material in a selected direction at a selected rate;

a looptaker for cooperation with said sewing needle in the formation of stitches;

a bobbin supported within said looptaker;

means for filling said bobbin with thread while supported within said looptaker;

a first means for sensing depletion of thread from said bobbin;

means responsive to said first sensing means for terminating operation of said work feeding system while simultaneously initiating operation of said bobbin filling means;

second means for sensing a full bobbin; and, means responsive to said second sensing means for terminating operation of said bobbin filling means and simultaneously reinitiating operation of said work feeding system.

2. A lockstitch sewing machine as claimed in claim 1 further comprising a basting stitch mechanism for holding in abeyance the endwise reciprocation of said needle bar, said basting stitch mechanism being made effective for holding in abeyance the endwise reciprocation of said needle bar by said means responsive to said first sensing means after initiating operation of said bobbin filling means, said basting stitch mechanism being made ineffective by said means responsive to said second sensing means.

3. A lockstitch sewing machine as claimed in claim 2 wherein said bobbin filling means further comprises an arm extending over said bobbin; and wherein said first sensing means further comprises means for enlarging said bobbin toward said arm in response to depletion of thread therefrom and a pair of overlapping conductors supported on said arm above said bobbin, said conductors being electrically isolated from each other except when said bobbin is enlarged by said bobbin enlarging means in response to depletion of thread therefrom.

4. A lockstitch sewing machine as claimed in claim 3, wherein said bobbin enlarging means comprises a lower flange having an upstanding post arranged concentrically thereon, said upstanding post having a slot extending transversely thereof, a bar affixed to said upstanding post in said slot thereof, an upper flange having a diametral groove in a lower surface thereof for accommodating said bar, a hollow tube affixed to said upper flange and slotted diametrically to accommodate said bar, said hollow tube slidably accommodated by said upstanding post extending into the hollow interior thereof, said hollow tube being fashioned on its external surface with an abrupt discontinuity space from said bar when said bar is seated in said diametral groove the approximate distance of one thickness of thread, and resilient means for urging said upper flange in a direction away from said lower flange.

* * * * *